United States Patent [19]

Groeneveld

[11] Patent Number: 4,884,495

[45] Date of Patent: Dec. 5, 1989

[54] FLUID MOTOR ACTUATOR WITH COMPRESSION SPRING FAIL-SAFE MECHANISM

[75] Inventor: Floris J. Groeneveld, Holland, Netherlands

[73] Assignee: EL-O-MATIC-USA, Inc., Hackensack, N.J.

[21] Appl. No.: 209,184

[22] Filed: Jun. 20, 1988

[51] Int. Cl.[4] ..... F01G 9/04

[52] U.S. Cl. ..... 92/130 C; 92/130 D; 92/131; 92/136

[58] Field of Search ..... 92/7, 130 C, 130 D, 92/131, 136, 138

[56] References Cited

U.S. PATENT DOCUMENTS

| | | | |
|---|---|---|---|
| 2,379,306 | 6/1945 | Larson et al. | 92/130 D X |
| 3,537,355 | 11/1970 | Bliss | 92/131 X |
| 3,991,661 | 11/1976 | Mocha | 92/131 |
| 4,354,424 | 10/1982 | Nordlund | 92/130 D X |
| 4,478,240 | 10/1984 | Tanner | 92/131 X |
| 4,585,024 | 4/1986 | Esseniyi | 92/131 X |

FOREIGN PATENT DOCUMENTS

| | | | |
|---|---|---|---|
| 142034 | 1/1976 | United Kingdom | 92/130 C |
| 2077355 | 12/1981 | United Kingdom | 92/136 |

*Primary Examiner*—Robert E. Garrett
*Assistant Examiner*—Mark A. Williamson
*Attorney, Agent, or Firm*—Samuelson & Jacob

[57] ABSTRACT

A fluid motor actuator of the type in which an actuator member is moved in either one of two opposite directions from a rest position to an actuated position includes a fail-safe mechanism having compression springs coupled with the actuator member for compression of the compression springs in response to actuation of the actuator member in either of the two opposite directions for establishing a restoring force which, upon loss of motive power, will return the actuator member to the rest position and maintain the actuator member in the rest position pending restoration of motive power.

1 Claim, 1 Drawing Sheet

FLUID MOTOR ACTUATOR WITH COMPRESSION SPRING FAIL-SAFE MECHANISM

The present invention relates generally to fluid motor actuators and pertains, more specifically, to a fluid motor actuator in which an actuator member is moved from a rest position to an actuated position and a fail-safe mechanism assures that upon loss of motive power, the actuator member is returned to the rest position.

Fluid motor actuators of the type in which pistons reciprocate within a fluid cylinder in response to fluid pressure and are coupled to an actuator shaft by a rack and pinion arrangement are well known. Examples of such actuators are described in U.S. Pat. No. 4,203,351. One of the most common uses of such actuators is in the operation of valves where the actuator is employed to turn a valve operator, usually through ninety degrees of rotation, between a closed position and an open position. Many of these actuators are provided with a "fail-safe" mechanism, commonly in the form of a spring, which, in the event of the failure of motive power, returns the actuator to a rest position and, at the same time, moves the valve operator to the closed position of the valve.

Where fluid motor actuators are used in connection with multi-port valves, the valve operator can be moved to one of three positions, usually spaced apart by ninety degrees of rotation, with the zero degree and the one-hundred-eighty degree positions being open positions, and the ninety degree position being the closed position of the valve. In order to move the valve operator to the fail-safe closed position, an auxiliary fluid supply system is incorporated to assure that upon failure of the main motive fluid supply system, the auxiliary fluid supply system will move the valve operator to the ninety degree position and maintain the valve closed. The present invention eliminates the need for an auxiliary fluid supply system and provides a balanced compression spring fail-safe mechanism which, in the event of a motive fluid power failure, will move the valve operator to the ninety degree position, from either the zero degree or the one-hundred-eighty degree position, to close the valve and maintain the valve closed.

Accordingly, the present invention provides a fail-safe mechanism for fluid motor actuators, which mechanism exhibits several objects and advantages, some of which may be summarized as follows: Moves the actuator member positively from an actuated position to a defined fail-safe rest position and maintains the actuator member at the defined fail-safe rest position upon the failure of motive power, utilizing a compression spring arrangement to move the actuator member to and to maintain the actuator member at the desired fail-safe position; maintains all compression springs in compression during all movements of the actuator member and while the actuator member is maintained by the fail-safe mechanism at the defined fail-safe rest position; enables simplified design for ease of manufacture and for economy; and enables rugged construction for effective performance under a variety of operating conditions and over a long service life.

The above objects and advantages, as well as further objects and advantages, are attained by the present invention which may be described briefly as providing, in an actuator in which an actuator member is moved, in response to the application of motive power, from a rest position to either one of first and second actuated positions located in opposite directions away from the rest position, a fail-safe mechanism for assuring that upon loss of the motive power, the actuator member is returned to and retained at the rest position, the fail-safe mechanism comprising: a locator member coupled with the actuator member for movement from a rest location, corresponding to the rest position of the actuator member, to either one of first and second locations placed in opposite first and second directions away from the rest location, the first and second locations corresponding to the respective first and second actuated positions of the actuator member; resiliently compressible means; and lost-motion means coupling the locator member with the resiliently compressible means such that upon movement of the locator member away from the rest location, toward either one of the first and second locations, the resiliently compressible means is compressed to establish a resilient restoring force tending to restore the locator member to the rest location so that upon the loss of motive power, the resiliently compressible means will restore the locator member to the rest location and the actuator member to the rest position.

The invention will be understood more fully, while still further objects and advantages will become apparent, in the following detailed description of a preferred embodiment of the invention illustrated in the accompanying drawing, in which.

Figure 1:
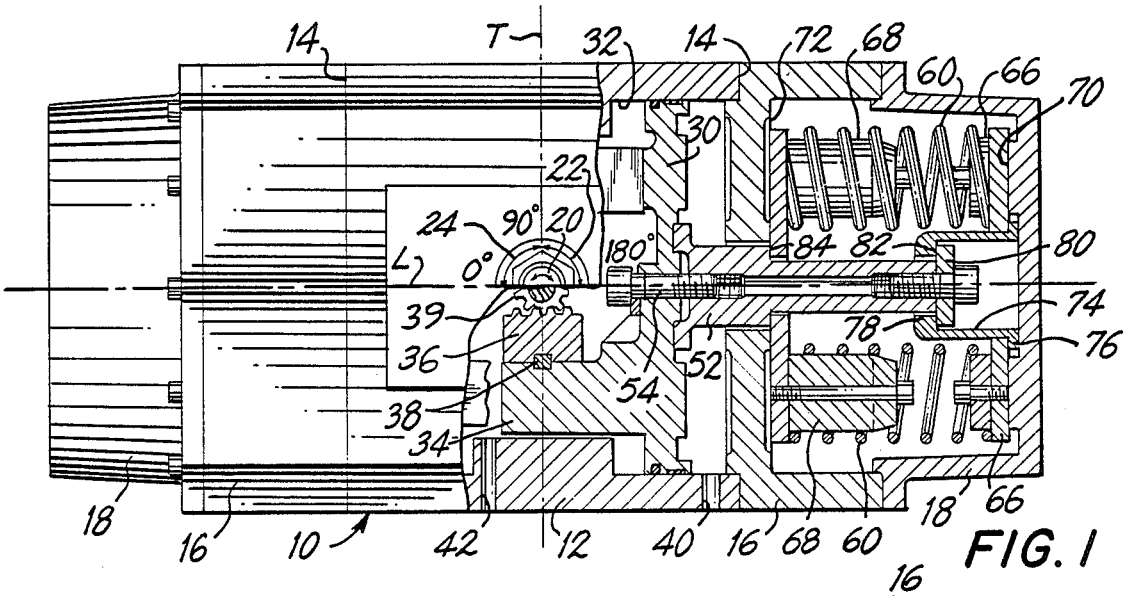
FIG. 1 is plan view, partially sectioned, of a fluid motor actuator constructed in accordance with the invention.

Referring now to the drawing, and especially to FIG. 1 thereof, a fluid motor actuator constructed in accordance with the invention is illustrated generally at 10 and is seen to include a central casing 12 extending longitudinally between opposite ends 14 and carrying a housing 16 at each end 14. An end cap 18 closes each housing 16 to complete the outer structure of the fluid motor actuator 10. The structure of the fluid motor actuator 10 is generally symmetrical about a transverse plane, represented by transverse line T, and includes a central longitudinal axis L. An actuator member in the form of a drive shaft 20 projects from the central casing 12. In the position shown in FIG.1, the drive shaft 20 is at a rest position. Fluid motor actuator 10 may be actuated to move the drive shaft 20 from the rest position to either one of two actuated positions. Thus, drive shaft 20 may be moved through ninety degrees of rotation in the clockwise direction, as represented by the arrow 22, to a first actuated position, or through ninety degrees of rotation in the counter-clockwise direction, as represented by the arrow 24, to a second actuated position. The two actuated positions are represented in FIG. 1 by the 0° position and the 180° position, while the rest position is represented by the 90° position.

Figure 2:
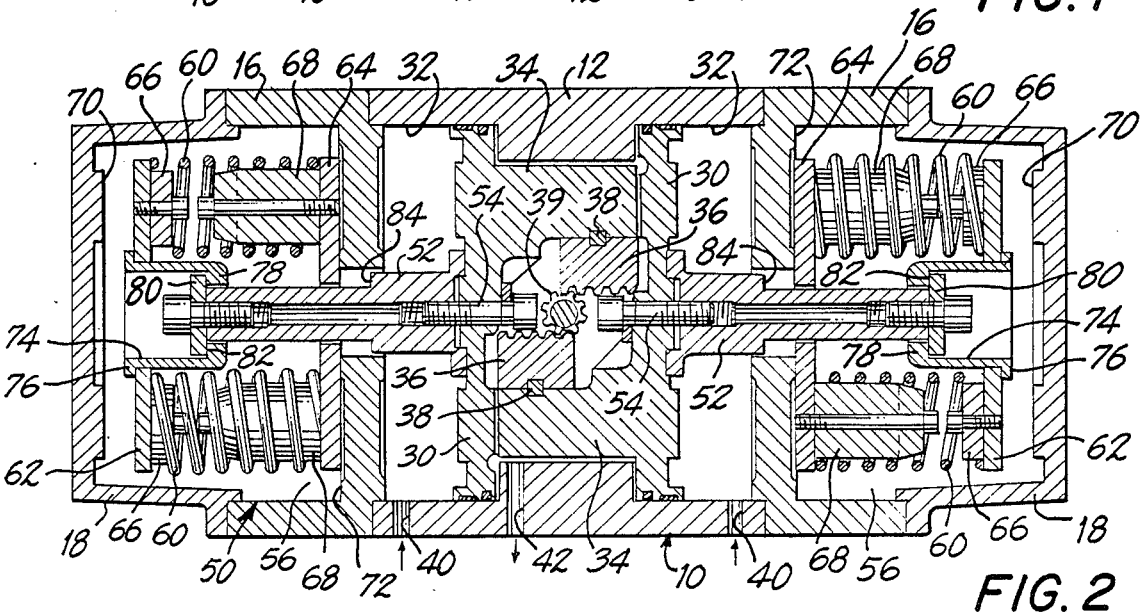
FIG. 2 is a longitudinal cross-sectional view of the fluid motor actuator, with the operating component parts in another operating position.
Figure 3:
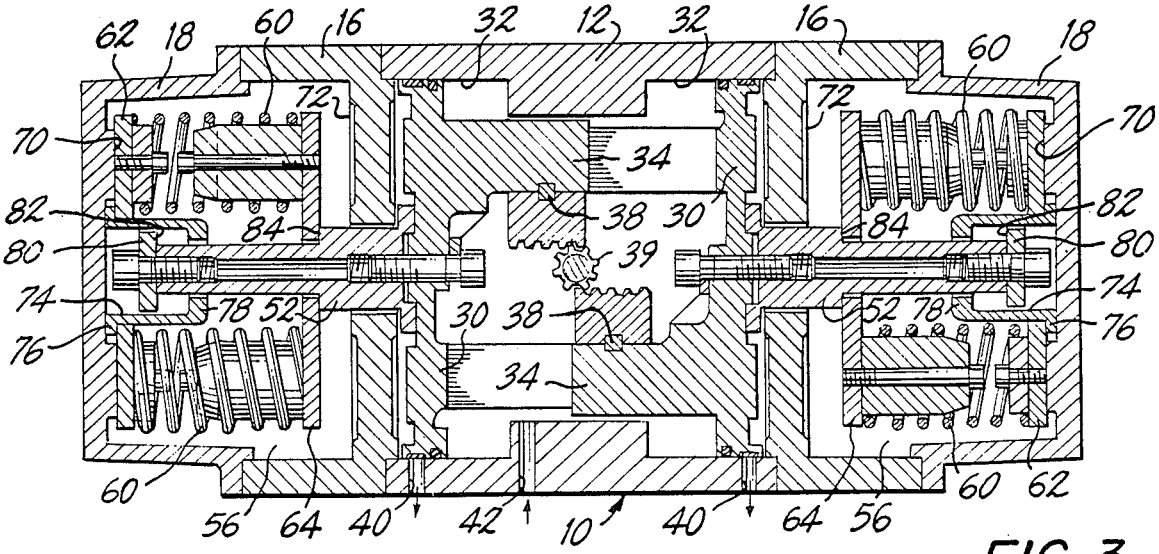
FIG. 3 is a longitudinal cross-sectional view of the fluid motor actuator, with the operating component parts in still another operating position.

Turning now to FIGS. 2 and 3, as well as to FIG. 1, opposed pistons 30 are placed within complementary cylinders 32 in central casing 12 for reciprocating linear movement toward and away from one another. Drive means couple each piston 30 with drive shaft 20 and include an extension 34 which carries a rack 36 keyed to the extension 34 at 38 for movement with each piston 30. Each rack 36 is meshed with a pinion 39 integral with the drive shaft 20 so that upon reciprocating movement of the pistons 30, drive shaft 20 will be moved from the rest position, shown in FIG. 1, to either one of the actuated positions. In FIG. 2, fluid under pressure has been introduced into cylinders 32 through ports 40 and a port 42 has been opened to exhaust so as to move the pistons 30 toward one another, and drive shaft 20 has been moved to the 180° position. In FIG. 3, fluid under pressure has been introduced through port 42 and ports 40 have been opened to exhaust to move the pistons 30 away from one another, and drive shaft 20 has been moved to the 0° position. Fluid actuator 10 is a pneumatic actuator and the motive fluid is air.

In the event of a failure of motive power, that is, should the supply of fluid under pressure be interrupted, it is desired that the drive shaft 20 be returned to the rest position, depicted as the 90° position. Thus, for example, where the fluid motor actuator 10 is coupled to a multi-port valve (not shown) in which the 90° position of the drive shaft 20 corresponds to the closed position of the valve, while the 0° and 180° positions correspond to open positions of the valve, safety considerations may require that the valve be closed in the event of a motive power failure. Accordingly, fluid motor actuator 10 is provided with a fail-safe mechanism 50 which assures that drive shaft 20 is moved to and is maintained at the rest position upon the discontinuance of the supply of fluid under pressure.

Fail-safe mechanism 50 includes a locator member in the form of a rod 52 affixed to each piston 30, as by a threaded fastener 54, such that each rod 52 is integral with a piston 30, moves with that piston, and extends out of the corresponding cylinder 32 and into a chamber 56 within housing 16 and end cap 18. Each chamber 56 houses a resiliently compressible means in the form of helical compression springs 60 which extend between opposed outer and inner annular plates 62 and 64. Posts 66 and 68 are secured to respective outer and inner plates 62 and 64 and assist in maintaining the compression springs 60 located and aligned along the longitudinal direction. When the drive shaft 20 is at the rest position, that is, at the 90° position, as depicted in FIG. 1, outer plate 62 is urged against stop means, in the form of end wall 70 of end cap 18, and inner plate 64 is urged against stop means, in the form of end wall 72 of housing 16, by the resilient biasing force of the compression springs 60. Outer plate 62 is coupled to rod 52 by means of a cup 74 having an outer flange 76, which engages outer plate 62, and an inner flange 78 slidably engaging rod 52. A disk 80 is affixed to rod 52 at the outer end thereof and establishes an outer shoulder 82 which is seated against the inner flange 78 of cup 74. At the same time, inner plate 64 is seated against an inner shoulder 84 on rod 52, inner shoulder 84 confronting outer shoulder 82 and being spaced longitudinally therefrom. In the absence of pressurized fluid in the cylinders 32, the longitudinal spacing between the shoulders 82 and 84 locates each rod 52, and each corresponding piston 30, in the intermediate position (rest location) shown in FIG. 1, corresponding to the rest position of the drive shaft 20. Upon introducing fluid under pressure into cylinders 32, through the ports 40, the pistons 30 will be driven toward one another to the actuated position depicted in FIG. 2, rotating the drive shaft 20 clockwise to the 180° actuated position. Rods 52 are drawn inwardly toward one another with pistons 30, and outer plates 62 are moved toward one another, thereby compressing the compression springs 60. Such movement of the pistons 30, and the corresponding rods 52, is permitted by the lost-motion means provided by the sliding connection between each rod 52 and the corresponding inner plate 64. It is noted that all of the compression springs 60 are compressed and all are compressed equally, providing a stable, balanced resilient biasing force tending to restore the pistons 30 to the intermediate position. Should there be a failure of motive power, that is, should the supply of fluid under pressure at ports 40 be discontinued, the compression springs 60 will urge the outer and inner plates 62 and 64 against the respective stop means provided by end walls 70 and 72, and rods 52 will be located at the intermediate position (rest position), along with pistons 30, as shown in FIG. 1, to return the drive shaft 20 to the rest position. As best seen in FIG. 3, upon the introduction of fluid under pressure through port 42, pistons 30 are driven outwardly away from one another to rotate drive shaft 20 counter-clockwise to the 0° actuated position. Inner plates 64 are coupled with the rods 52 and move longitudinally outwardly, while the outer plates 62 are urged against the stop means provided by end walls 70, thereby compressing all of the compression springs 60. Should the supply of pressurized fluid at port 42 be interrupted, the biasing force of compression springs 60 will return the inner plates 64, the rods 52, and the corresponding pistons 30 to the intermediate position (the rest position) shown in FIG. 1, thereby returning the drive shaft 20 to the 90° rest position.

It will be seen that fail-safe mechanism 50 provides each piston 30 with a respective compression spring arrangement so that all of the restoring forces are balanced and stable. Compression springs 60 are always in compression between the outer and inner plates 62 and 64, thus eliminating the need for anchoring either end of any of the compression springs 60 to any other structure. In this manner, the compression springs 60 are utilized most effectively. The coupling of the compression springs 60 with the rods 52 through the use of shoulders 82 and 84 assures that the rods 52, and the pistons 30, will be returned to and retained accurately at the desired intermediate position (rest location) corresponding to the rest position of the drive shaft.

It is to be understood that the above detailed description of an embodiment of the invention is provided by way of example only. Various details of design and construction may be modified without departing from the true spirit and scope of the invention, as set forth in the appended claims.

The embodiments of the invention in which an exclusive property or privilege is claimed are defined as follows:

1. In an actuator in which an actuator member is moved, in response to the application of motive power, from a rest position to either one of first and second actuated positions located in opposite directions away from the rest position, the actuator including opposed motor means for driving the actuator member from the rest position toward the respective first and second actuated positions, each motor means comprising a fluid motor including a cylinder and a piston movable within the cylinder along a central longitudinal axis, and each piston reciprocating along a linear path of travel, a fail-safe mechanism for assuring that upon loss of said motive power, the actuator member is returned to and retained at the rest position, the fail-safe mechanism comprising:

a locator member associated with each motor means, each locator member comprising a longitudinally extending rod coupled with the actuator member for reciprocating movement along a linear path of travel from a rest location, corresponding to said rest position of the actuator member, to either one of first and second locations placed in opposite first and second directions away from the rest location, the first and second locations corresponding to the respective first and second actuated positions of the actuator member;

drive means coupling each rod with the actuator member for rotation of the actuator member between the rest position and either one of said first and second actuated positions in response to reciprocation of the rods;

resiliently compressible means associated with each locator member, each resiliently compressible means including at least one pair of compression springs, the compression springs of the pair being spaced laterally away from the central longitudinal axis and being located diametrically opposite one another relative to the central longitudinal axis; and lost-motion means coupling each locator member with the respective resiliently compressible means such that upon movement of the locator member away from the rest location, toward either one of the first and second locations, the corresponding resiliently compressible means is compressed to establish a resilient restoring force tending to restore the corresponding locator member to the rest location so that upon said loss of motive power, the resiliently compressible means will restore the locator members to the rest location and the actuator member to the rest position, each lost-motion means including longitudinally spaced apart confronting first and second shoulders movable with the corresponding rod, the first coupling member being placed adjacent the first shoulder for engagement and movement therewith when the corresponding locator member is moved in the first direction from the rest location toward one of said first and second locations and the second coupling member being placed adjacent the second shoulder for engagement and movement therewith when the corresponding locator member is moved in the second direction from the rest location toward the other of the first and second locations, and confronting first and second stop means spaced apart longitudinally, each stop means being associated with a corresponding coupling member for precluding movement of the second coupling member in the first direction during movement of the first coupling member in the first direction, and for precluding movement of the first coupling member in the second direction during movement of the second coupling member in the second direction, such that the compression springs of the corresponding pair of compression springs are compressed between the coupling members and bias each coupling member toward a corresponding stop means, the stop means being located relative to the rest location of the shoulders such that each coupling member engages a corresponding shoulder and a corresponding stop means to place the corresponding rod at the rest location in response to the bias of the corresponding compression springs.

* * * * *